United States Patent [19]

Schulze

[11] 4,030,652

[45] June 21, 1977

[54] EQUALIZING DEVICE FOR MOVEMENTS IN PACKING MACHINES, ESPECIALLY MACHINES FOR MAKING BAGS AND THE LIKE

[75] Inventor: Ehrhart Schulze, Fellbach, Germany

[73] Assignee: Felix Stiegler Maschinenfabrik, Stuttgart, Germany

[22] Filed: Apr. 5, 1976

[21] Appl. No.: 673,421

[30] Foreign Application Priority Data

Apr. 3, 1975 Germany ..... 2514600

[52] U.S. Cl. ..... 226/114; 226/95; 226/117; 226/119; 226/189; 242/75.3; 242/154

[51] Int. Cl.[2] ..... B65H 17/42

[58] Field of Search ..... 226/114, 119, 118, 117, 226/44, 195, 95, 189; 242/75.3, 154

[56] References Cited

UNITED STATES PATENTS

| | | | |
|---|---|---|---|
| 2,864,176 | 12/1958 | Backlert et al. | 226/95 |
| 2,964,259 | 12/1960 | Peel | 242/154 |

FOREIGN PATENTS OR APPLICATIONS

| | | | |
|---|---|---|---|
| 1,704,187 | 4/1971 | Germany | 226/114 |
| 1,942,410 | 3/1970 | Germany | 226/114 |

*Primary Examiner*—Evon C. Blunk
*Assistant Examiner*—Bruce H. Stoner, Jr.
*Attorney, Agent, or Firm*—Walter Becker

[57] ABSTRACT

A device for equalizing movements in packing machines, especially machines for making bags, which is arranged between a first continuously working withdrawing device for foil-shaped packing material and a second intermittently working second withdrawing device. The device comprises a spring-urged pivotable lever and a stationary support each carrying a plurality of rotatable journalled guiding rollers arranged one behind the other and in spaced relationship to each other. The packing material is looped alternately over one guiding roller on the pivotable lever and a guiding roller on the stationary support and in this manner successively over all guiding rollers in a progressive way, the distance between each two adjacent guiding rollers of the pivotable lever varying in length.

3 Claims, 3 Drawing Figures

1
2
3
4
5
6
7
8
9
10
11
12
13
14
15
16
17
18
19
20
21
22
23
24
25
26
27
28
29
30
31
32
33
34
35
36
37
38
39
S
M1
M2

EQUALIZING DEVICE FOR MOVEMENTS IN PACKING MACHINES, ESPECIALLY MACHINES FOR MAKING BAGS AND THE LIKE

The present invention relates to a compensating device for compensating movements in packing machines, especially in machines for making bags and the like, which is arranged between a first continuously operating withdrawing device for foil-shaped wrapping materials, and a second intermittently operating withdrawing device and which comprises a spring urged pivot lever as well as a stationary carrier respectively equipped with a plurality of rotatably journalled guiding rollers arranged in spaced relationship to and one behind the other while the wrapping material is passed in loops respectively about guiding rollers of the pivot lever and a guiding roller of the carrier. Compensating devices of this type are described for instance in German Offenlegungsschrift Nos. 1,704,187 and 1,942,410.

With heretofore known wrapping machines, the paper, viscous foil (Zellglas) or metal foil is withdrawn continuously from a supply roll and is conveyed to a processing station intermittently or pulse-wise. For purposes of receiving the wrapping material withdrawn from the processing station during the pulse intervals, a compensating device for compensating or equalizing movements is arranged between a first continuously operating withdrawing device and a second intermediately operating withdrawing device. The said compensating device, with heretofore known wrapping machines as disclosed for instance in German Offenlegungsschrift Nos. 1,704,187 and 1,942,410 comprises a stationary roller arrangement and a roller arrangement which is mounted on a spring actuated oscillating or pivot lever. Said last mentioned roller arrangement comprises a plurality of serially arranged and mutually spaced guiding rollers which are rotatably journalled.

However, experience has shown that the heretofore known compensating devices will at withdrawing speeds exceeding 50 meters per minute no longer work in a jerk-free manner. As a result thereof, shocks and tension peaks occur in the foil-shaped wrapping material which may bring about that the material sections fed to the processing station differ in length. Furthermore, a stand-still of the wrapping material behind the heretofore known compensating device for movements during the pulse intervals of the intermittently operating withdrawing device will no longer be assured so that a processing of the wrapping material during these stand-still periods will no longer be possible.

It is, therefore, an object of the present invention to improve a movement compensating device of the above mentioned general type so that also at higher withdrawing speeds of the wrapping material, especially during the starting phase of the wrapping machine, a jerk-free conveying movement of the wrapping material will be assured.

These and other objects and advantages of the invention will appear more clearly from the following specification in connection with the accompanying drawings, in which.

The compensating device according to the present invention is characterized primarily in that the distance between each two adjacent guiding rollers of the oscillating lever are different in length. The present invention is based on the finding that the arrangement of the rollers on the oscillating lever at equal distances from each other is the cause for the above mentioned jerky movements at higher withdrawing speeds. Based on this finding, with the movement compensating device according to the invention, the mutual distances of adjacent guiding rollers of the oscillating lever have been selected of different lengths. According to a preferred embodiment of the invention, the distance between adjacent guiding rollers increases in the withdrawing direction of the wrapping material. This increase in the mutual distance follows according to a particularly advantageous embodiment of the invention the formula: $a \times 2^n$, in which $a$ indicates the distance between the first and second guiding rollers of the oscillating lever when viewing in the direction of withdrawal of the wrapping material. The letter $n$ indicates a whole number of the numbers 0,1,2,3,4, etc. which designates the order of the respective distance.

Due to the different dimensioning of the distances between adjacent guiding rollers of the oscillating lever, it is possible, also with high withdrawing speeds of the wrapping material within the range of from 50 to 80 meters per minute to assure a jerk-free conveying movement of the wrapping material. When employing elastic wrapping material as for instance foils of synthetic material, it is favorable to cushion oscillations caused by the elasticity of the wrapping material at the down-stream end of the compensating device according to the invention and to do this cushioning by means of a non-rotatably journalled suction roller over which the wrapping material is passed prior to entering the second intermittently operating withdrawing device.

Figure 1:
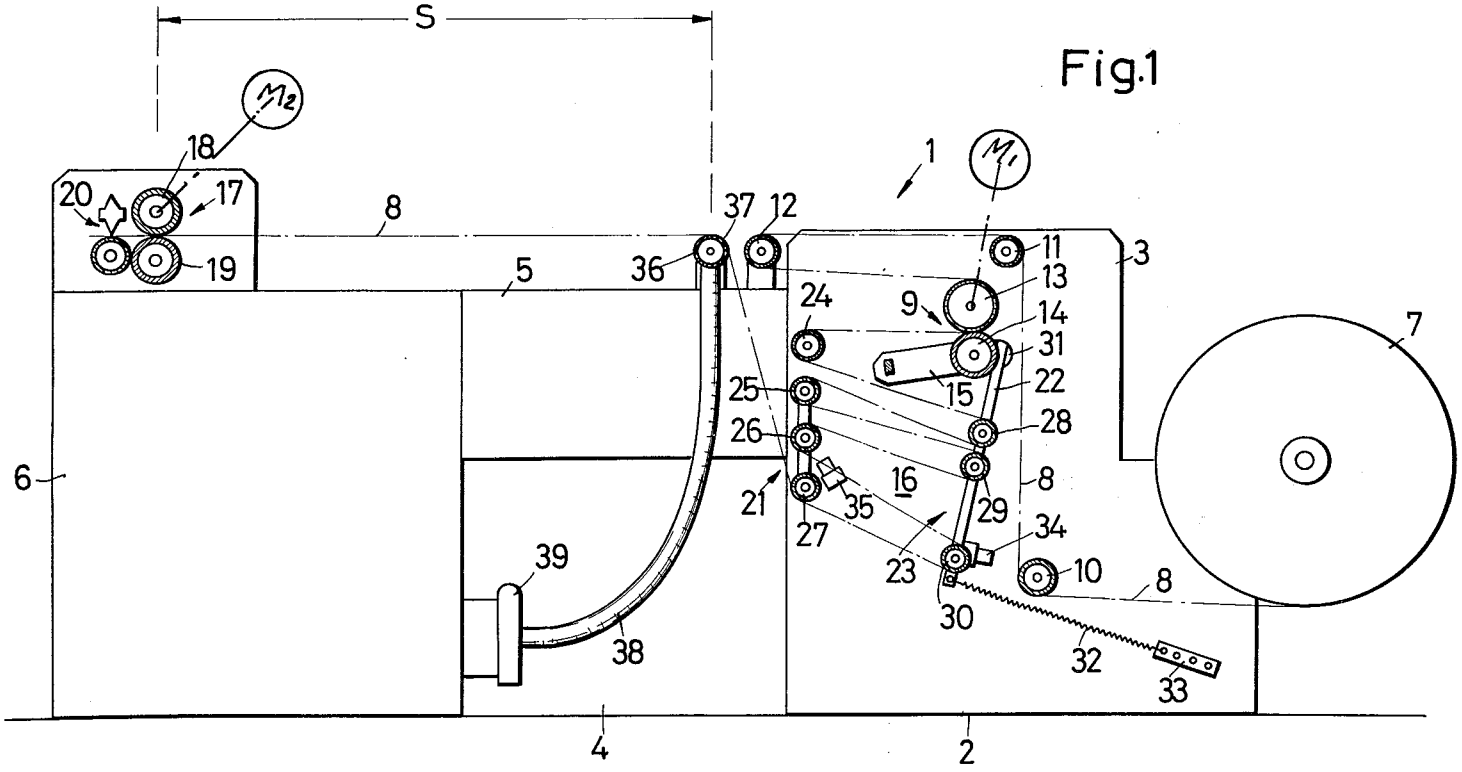
FIG. 1 is a side view of a wrapping machine with a compensating device according to the invention.

Referring now to the drawings in detail, the bag manufacturing machine 1 shown in FIG. 1 comprises a foundation 2 with a pair of lateral or side sections 3 and a pair of lateral sections 6 between which there is provided a chamber 4 and a bridge-like pair of side sections 5. The side sections 3 have rotatably mounted thereon a supply roller 7 for the wrapping material to be processed, especially a foil 8 of synthetic material. The foil 8 of synthetic material is by means of a first continuously operating withdrawing device 9 drawn off over rollers 10, 11 and 12. The withdrawing device 9 comprises a first roller 13 which is driven by $M_1$, an electric motor or hydraulic motor in a continuous manner and furthermore comprises a roller 14 which follows said first roller 13 and is rotatably journalled on a spring urged pivotal lever 15. The withdrawing device 9 feeds the foil 8 to the movement compensating device 16 according to the invention from where the foil 8 is withdrawn by means of a second intermittently or pulse-like operating second withdrawing device 17. The withdrawing device 17 is connected to the frame section 6 and comprises a roller pair 18, 19 which is driven by an intermittently operating driving system $M_2$. The first roller 18 of said roller pair 18, 19 is driven and its second roller 19 is taken along by said first roller. Past said second withdrawing device 17 there is provided a cutting device 20 for cutting off the foil 8 into equally long sections.

The movement compensating device 16 comprises a first roller arrangement 21 which is rotatably journalled on the frame section 2, and also comprises a second roller arrangement 23 which is rotatably journalled on an oscillating lever 22. The first roller arrangement 21, according to the illustrated embodiment of the invention includes four serially arranged guiding rollers 24–27 which are spaced from each other at equal distances. The second roller arrangement 23 according to the exemplary illustration shown in the drawings includes three serially arranged guiding rollers 28, 29 and 30 which, however, are unequally spaced from each other. The oscillating lever 22 has one of its ends rotatably pivotally connected to the bearing pin 31 and has its other end connected to a return spring 32 which is suspended in an opening of the perforated plate 33. The oscillating movement of the oscillating lever 22 about the bearing pivot 31 is limited by two abutments 34 and 35. The foil 8 of synthetic material is looped around one guiding roller for instance 24, of the first stationary roller arrangement 21 and about one guiding roller for instance 28, of the second pivotable roller arrangement 23. In the down stream end of the movement compensating device 16, a suction roller 36 is nonpivotally journalled on the frame plate 5. The suction openings 37 of said suction roller 36 are through a hose 38 connected to a vacuum pump 39.

Figure 2:
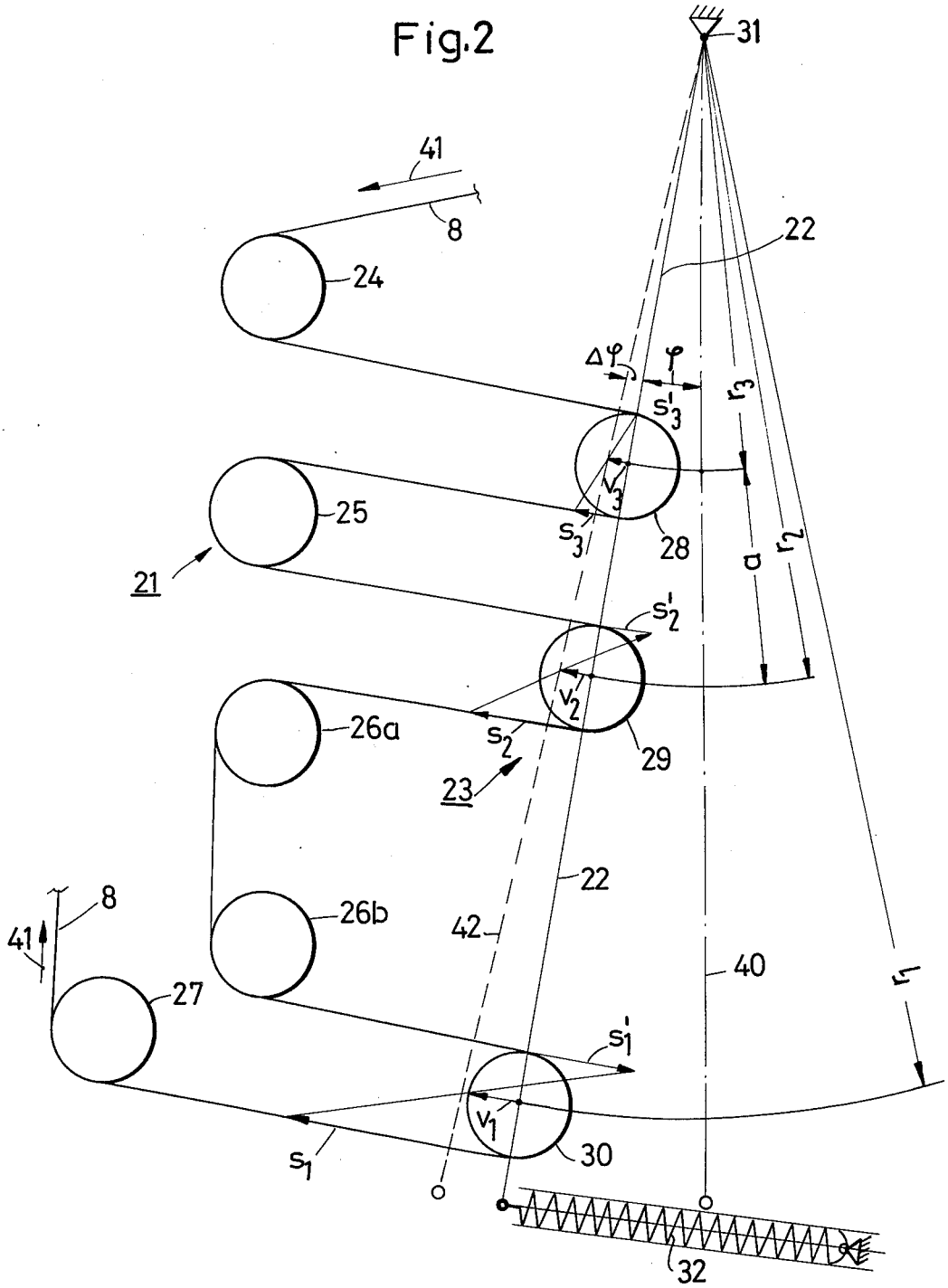
FIG. 2 is a diagrammatic illustration of a movement compensating device according to the invention with stroke and speed vectors for the wrapping material which in the form of loops passes through the movement compensating device.

The selection of the different distances between each two adjacent guiding rollers 28, 29 and 30 of the second roller arrangement 23 journalled on the pivotable lever 22, and the manner of function of said rollers 28, 29 and 30 will now be explained in connection with the diagrammatic illustration of FIG. 2. FIG. 2 shows the pivotable lever 22 which is pivotally connected to the bearing pivot 31 and the return spring 32. Lever 22 is pivoted out of its rest position 40 indicated by dot-dash lines, by an angle $\phi$. The guiding rollers 28, 29 and 30 are rotatably journalled on the pivotable lever 20. The pivot points of the guiding rollers 28–30 are spaced from the bearing pin 31 by the distances $r_3$, $r_2$ and $r_1$ respectively. According to the invention, the distance $r_1-r_2$ between the guiding rollers 30 and 29 is greater than the distance $r_2-r_3$ between the guiding rollers 29 and 28. The distance between adjacent guiding rollers of the pivotable lever 22 thus increases in the withdrawing direction 41 of the foil 8 of synthetic material. As shown in FIG. 1, the foil 8 is looped around one roller 24–27 of the first roller arrangement 21 and is looped around a guiding roller 28–30 of the second roller arrangement 23 journalled on the pivotable lever 22. With the diagrammatically illustrated first roller arrangement 21 of FIG. 2, roller 26 is according to FIG. 1 divided into two rollers **26*a* and 26*b*** for reason of assuring a better tangential guiding of the foil of synthetic material with regard to the guiding rollers.

The distance between adjacent guiding rollers of the second roller arrangement 23 meets in a preferred manner the relationship $a \times 2^n$, wherein $a$ designates the distance $r_2-r_3$ between the centers of rotation of the first guiding roller 28 and the second guiding roller 29 and $n$ indicates a whole number designating the order of the respective contemplated distance and selected from the row of numbers 0,1,2,3,4, . . . . In the contemplated example, $n$ equals 1 so that the first distance, i.e. the distance between the centers of rotation of the guiding rollers 30 and 29 equals $2a$.

It will be appreciated that the above mentioned relationship for the dimensioning of the individual distances between the centers of rotation of the guiding rollers of the second roller arrangement 23 has been given merely by way of example and that the invention is by no means limited thereto.

The technical success realized by the dimensioning according to the invention of the distances between adjacent guiding rollers of the second roller arrangement 23 will now be illustrated by means of the stroke and velocity vectors $s_1-s_3$; $v_1-v_3$ illustrated in FIG. 2. This vector illustration corresponds to the well-known graphic velocity and stroke ascertainment in roller transmission control mechanisms as disclosed in the handbook, "Grundzuege der Getriebelehre" (Principles of Transmission Theory) volume 1 by Jahr and Kuechtel, pages 92–95. The vectors $s_1$, $s'_1$, $s_2$, $s'_2$, $s_3$ and $s'_3$, represent the movement of the webs of the foil 8 of synthetic material according to which the pivotable lever 22 moves by the angle $\Delta\phi$ to the position 42 indicated by dash lines. The velocity factors $v_1$, $v_2$ and $v_3$ indicate the amount and direction of the movement of the centers of rotation of the respective guiding rollers 30, 29; 28. As will be seen from FIG. 2, the amounts of the velocity vectors $v_1-v_3$ correspond to the stoke performed by the center of rotation of the associated guiding roller 30, 29, 28 at a rotation of the pivotable lever 22 by the angle $\Delta\phi$ to the position 42. The ascertainment of the stroke vectors $s_1-s_3$ as well as $s'_1-s'_3$ is effected in the following manner: starting from the assumption which has been proven in practice that during the first withdrawing jerk of the foil 8, the foil section between the rollers 24 and 28 is not yet moved, the stroke vector $s'_3$ equals zero. The tip of the stroke vector $s'_3$ is, therefore located at the contacting point between the guiding roller 28 and that section of foil 8 which is located between the rollers 24 and 28. If a straight line is drawn from the tip of the stroke vector $s'_3$ to the tip of the stroke vector $v_3$, this straight line will intersect with the section of foil 8 between the rollers 25 and 28 at the tip of the stroke vector $s_3$. Thus the stroke vector $s_3$ is ascertained graphically. Inasmuch as the length of the stroke vector $s_3$ equals the length of the stroke vector $s'_2$, also the stroke vector $s'_2$ is directly ascertained therefrom. If now from the tip of the stroke vector $s'_2$ a straight line is drawn to the tip of the velocity vector $v_2$, the point of intersection between this straight line and the section of foil 8 between the rollers **26*a* and 29 furnishes the tip of the stroke vector $s_2$. Since the length of the stroke vector $s_2$ equals the length of the stroke vector $s'_1$, immediately also the stroke vector $s'_1$ is obtained. The straight line between the tips of the vectors $s'_1$ and $v_1$ will by means of its point of intersection with the section of foil 8 between the rollers 27 and 30** furnish the tip of the stroke vector $s_1$.

Figure 3:
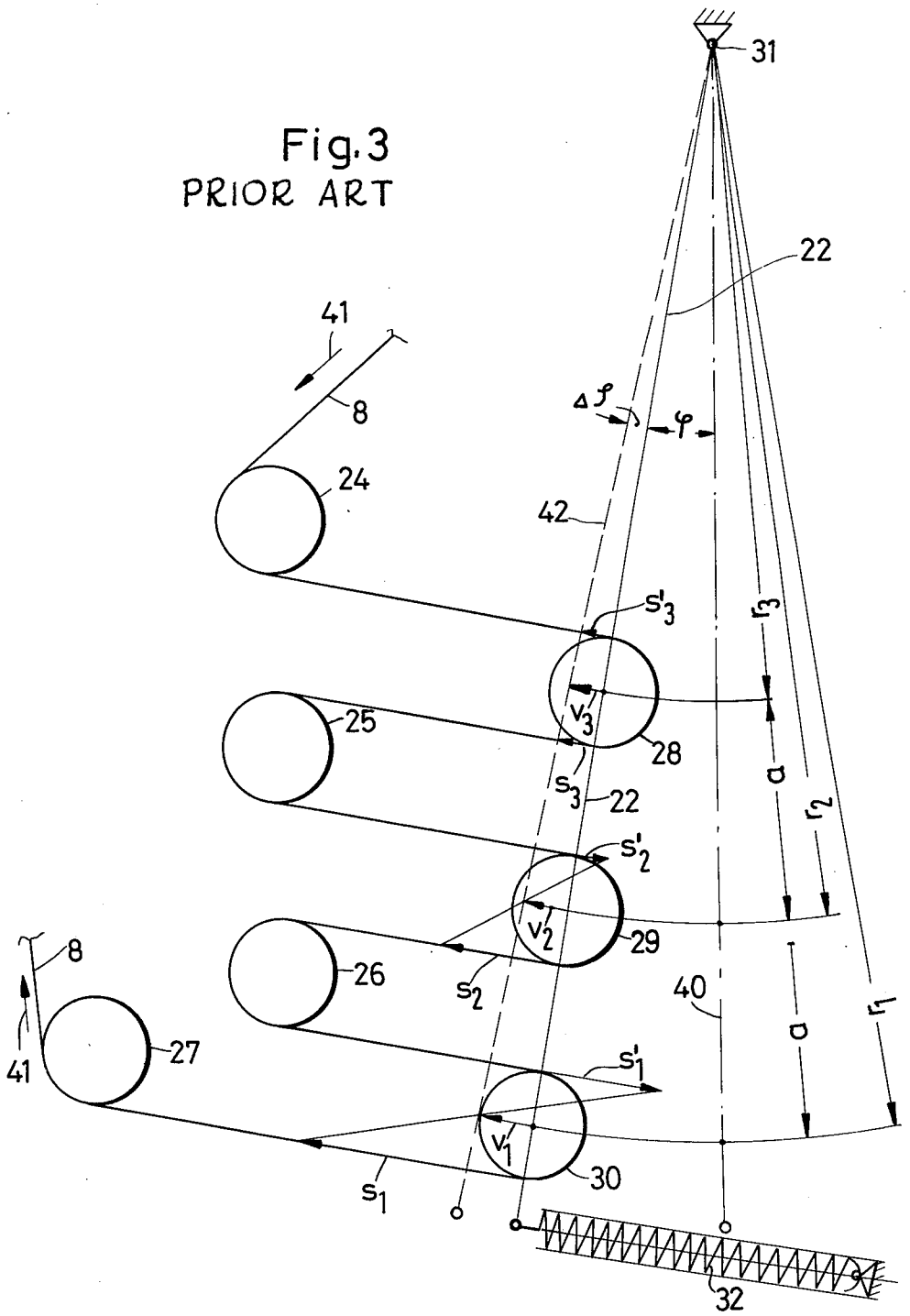
Fig. 3 PRIOR ART
FIG. 3 represents a diagrammatic illustration similar to that of FIG. 2 but for a heretofore known movement compensating device.

FIG. 3 illustrates in a similar diagrammatic illustration as FIG. 2 a heretofore known movement equalizing device with guiding rollers 28, 29 and 30 arranged at equal mutual distances, for comparison of the individual stroke vectors at the guiding rollers 28–30. For purposes of creating equal relationships, the length of the stroke vector $s_1$ in FIG. 3 corresponds to the length of the stroke vector $s_1$ in FIG. 2. If now by connecting the tips of the vectors $s_1$ and $v_1$ in FIG. 3, the stroke vector $s'_1$ is ascertained and thereby also the stroke vector $s_2$, it will be found that the stroke vectors $s'_1$ and $s_2$ equal the corresponding stroke vectors in FIG. 2. The remaining stroke vectors $s'_2$, $s_3$ and $s'_3$ in FIG. 3 differ, however, due to the other distances between the guiding rollers 28, 29 and 30 from the corresponding stroke vectors in FIG. 2. The ascertainment of the stroke vector $s'_2$ and thereby of the stroke vector $s_3$ is again effected by connecting the tips of the vectors $s_2$ and $v_2$. In a corresponding manner, the stroke vector $s'_3$ is ascertained. As will be seen from FIG. 3, the stroke vector $s'_3$ does, contrary to the condition in FIG. 2, not equal zero but is different from zero and directed toward the guiding roller 24. In order to be able to maintain the preload on the foil 8 in the known movement equalizing device, corresponding to the stroke vector $s'_3$, that portion of foil 8 which is located between rollers 28 and 24 should extend counter to the withdrawing direction of said portion of the foil 8. Inasmuch as this is not possible, the foil 8 will detach itself from the guiding roller 28 whereby the preload between the rollers 24 and 26 is eliminated. This in turn brings about that during the next following withdrawing period of the intermittently working withdrawing device 17 (FIG. 1) a jerk will occur in the foil 8.

The suction roller 36 which is illustrated in FIG. 1 and which is non-displaceably journalled at the down stream located end of the movement equalizing device 16 cushions the oscillations caused by the elasticity of the foil 8 so that in cooperation with the distance measurement according to the invention of the guiding rollers 28–30, the foil 8 will within the distance $s$ between the suction roller 37 and withdrawing device 17 be transported completely free of jerky movements. During the stand-still period of the withdrawing device 17, therefore, between the suction roller 37 and the roller 18, tools can be provided for the further processing or machining of the foil 8, for instance tools for providing perforations.

It is, of course, to be understood that the present invention is, by no means, limited to the specific showing in the drawings, but also comprises any modifications within the scope of the appended claims.

What I claim is:

1. In combination: supply reel means for receiving and supplying foil-shaped packing material, first withdrawing means for withdrawing packing material from said supply reel means, first driving means for continuously driving said first withdrawing means, equalizing means for receiving withdrawn packing material from said first withdrawing means and equalizing the movement thereof, second withdrawing means for withdrawing packing material from said equalizing means, and second driving means for intermittently driving said second withdrawing means, said equalizing means including a pivotally supported lever with a first set of rotatably mounted rollers differently spaced from each other, said equalizing means also including stationary supporting means, a second set of rotatably mounted guiding rollers supported by said supporting means and equally spaced from each other, spring means continuously urging said pivotally supported lever to pivot said first set of rollers away from said second set of rollers, said first set of rollers and said second set of rollers being arranged relative to each other so as to permit passing packing material received by said first withdrawing means over a first roller of said first set of rollers and from there over a first roller of said second set of rollers and from the latter to the successive second roller of said first set of rollers, and from there to the successive second roller of said second set of rollers and successively back and forth from one set of rollers to the other set of rollers while in each set of rollers progressively passing from one roller to the next roller, the distance between the rollers of said first set of rollers increasing in the direction of intended movement of packing material from over the rollers of said first set of rollers, the distance between the centers of rotation of each two adjacent rollers of said first set of rollers meeting the relationship $a \times 2^n$ in which $a$ designates the distance between the first and second rollers of said first set of rollers when looking in the direction in which the packing material is to move in succession over the rollers of said first set of rollers, and in which $n$ stands for a whole number of the row of numbers 0,1,2,3,4 . . . designating the order of the respective distance.

2. A combination according to claim 1, which includes a suction roller arranged at the downstream end of said equalizing means and interposed between the latter and said second withdrawing means for passing thereover the packing material leaving said equalizing means and prior to reaching said second withdrawing device.

3. A combination according to claim 2, in which said suction roller is journalled stationarily.

* * * * *